US010273781B2

(12) United States Patent
Themig et al.

(10) Patent No.: US 10,273,781 B2
(45) Date of Patent: Apr. 30, 2019

(54) STAGE TOOL FOR WELLBORE CEMENTING

(71) Applicant: Packers Plus Energy Services Inc., Calgary (CA)

(72) Inventors: Daniel Jon Themig, Calgary (CA); Christopher Denis Desranleau, Androssan (CA); James Fehr, Sherwood Park (CA)

( * ) Notice: Subject to any disclaimer, the term of this patent is extended or adjusted under 35 U.S.C. 154(b) by 0 days.

(21) Appl. No.: 15/483,777

(22) Filed: Apr. 10, 2017

(65) Prior Publication Data

US 2017/0211349 A1 Jul. 27, 2017

Related U.S. Application Data

(63) Continuation of application No. 14/808,167, filed on Jul. 24, 2015, now Pat. No. 9,650,868, which is a (Continued)

(51) Int. Cl.

| | |
|---|---|
| ***E21B 34/14*** | (2006.01) |
| ***E21B 33/14*** | (2006.01) |
| ***E21B 21/10*** | (2006.01) |
| ***E21B 34/10*** | (2006.01) |
| *E21B 34/00* | (2006.01) |
| *E21B 23/06* | (2006.01) |

(52) U.S. Cl.

CPC ..... *E21B 34/14* (2013.01); *E21B 21/103* (2013.01); *E21B 33/14* (2013.01); *E21B 33/146* (2013.01); *E21B 34/102* (2013.01); *E21B 23/06* (2013.01); *E21B 2034/007* (2013.01)

(58) Field of Classification Search

CPC ..... E21B 33/146; E21B 43/26; E21B 34/102; E21B 34/14; E21B 23/06; E21B 2034/007; E21B 33/14; E21B 21/103

See application file for complete search history.

(56) References Cited

U.S. PATENT DOCUMENTS 2,549,198 A 4/1951 Hayward
2,630,999 A * 3/1953 Lee ..... E21B 33/14 166/330

(Continued)

FOREIGN PATENT DOCUMENTS

EP 0622522 11/1993
EP 0913554 5/1999

(Continued)

OTHER PUBLICATIONS

Shaughnessy, John et al.; Optimizing HTHP Cementing Operations; IADS/SPE Drilling Conference, Dallas, Texas, USA, Feb. 26-28, 2002; IADC/SPE 74483.

(Continued)

*Primary Examiner* — Michael R Wills, III

(57) ABSTRACT

A stage tool for wellbore annular cementing may be opened for cementing by hydraulic actuation of a sliding sleeve valve from over a fluid port. After sufficient cement has been introduced, the stage tool fluid port can be closed by compressing two telescopically arranged parts of its tubular body to further overlap each other and overlie the fluid port. This permits the stage tool to be closed without employing a plug.

10 Claims, 7 Drawing Sheets

Related U.S. Application Data continuation of application No. 13/501,539, filed as application No. PCT/CA2010/001827 on Nov. 12, 2010, now Pat. No. 9,121,255.

(60) Provisional application No. 61/261,165, filed on Nov. 13, 2009.

(56) References Cited

U.S. PATENT DOCUMENTS

| | | | | |
|---|---|---|---|---|
| 2,663,307 | A * | 12/1953 | Birdwell | E21B 34/12 166/184 |
| 3,094,306 | A * | 6/1963 | Conrad | E21B 34/12 251/282 |
| 3,253,655 | A | 5/1966 | Brown | |
| 3,526,278 | A * | 9/1970 | Scott | E21B 34/125 166/152 |
| 3,789,926 | A | 2/1974 | Henley et al. | |
| 4,058,165 | A | 11/1977 | Holden et al. | |
| 4,333,530 | A | 6/1982 | Armstrong | |
| 4,403,659 | A | 9/1983 | Upchurch | |
| 4,429,747 | A | 2/1984 | Williamson | |
| 4,487,263 | A | 12/1984 | Jani | |
| 4,602,684 | A | 7/1986 | Van Wormer et al. | |
| 4,751,967 | A | 6/1988 | Blandford et al. | |
| 5,038,862 | A | 8/1991 | Giroux et al. | |
| 5,048,611 | A | 9/1991 | Cochran | |
| 5,314,015 | A | 5/1994 | Streich et al. | |
| 5,358,048 | A * | 10/1994 | Brooks | E21B 33/127 166/285 |
| 5,358,948 | A * | 10/1994 | Bradshaw | C07D 213/56 514/253.01 |
| 5,411,095 | A | 5/1995 | Ehlinger et al. | |
| 5,443,124 | A | 8/1995 | Wood et al. | |
| 5,474,128 | A * | 12/1995 | Bitting | E21B 17/07 166/242.7 |
| 5,494,107 | A | 2/1996 | Bode | |
| 5,609,178 | A | 3/1997 | Hennig et al. | |
| 5,800,538 | A | 9/1998 | Slepian et al. | |
| 5,826,661 | A | 10/1998 | Parket et al. | |
| 6,082,458 | A | 7/2000 | Schnatzmeyer | |
| 6,244,342 | B1 | 6/2001 | Sullaway et al. | |
| 6,293,342 | B1 | 9/2001 | McGarian et al. | |
| 6,799,635 | B2 | 10/2004 | Schultz et al. | |
| 6,802,374 | B2 | 10/2004 | Edgar et al. | |
| 6,907,936 | B2 | 6/2005 | Fehr et al. | |
| 7,090,020 | B2 | 8/2006 | Hill | |
| 7,108,067 | B2 | 9/2006 | Themig et al. | |
| 7,228,897 | B2 | 6/2007 | Holt, Jr. et al. | |
| 7,237,611 | B2 | 7/2007 | Vincent et al. | |
| 7,290,612 | B2 | 11/2007 | Rogers et al. | |
| 7,322,142 | B1 | 1/2008 | Badalamenti et al. | |
| 7,373,980 | B2 | 5/2008 | Lewis et al. | |
| 7,464,758 | B2 * | 12/2008 | Yeo | E21B 21/103 166/285 |
| 7,500,526 | B2 | 3/2009 | Telfer | |
| 7,654,324 | B2 | 2/2010 | Chase et al. | |
| 7,665,520 | B2 | 2/2010 | Szarka et al. | |
| 7,748,463 | B2 | 7/2010 | Revheim | |
| 7,762,333 | B2 | 7/2010 | Themig et al. | |
| 7,866,402 | B2 | 1/2011 | Williamson, Jr. | |
| 7,938,186 | B1 | 5/2011 | Badalamenti et al. | |
| 9,121,255 | B2 | 9/2015 | Themig et al. | |
| 2004/0177962 | A1 | 9/2004 | Bour | |
| 2006/0027371 | A1 * | 2/2006 | Gorrara | E21B 33/12 166/313 |
| 2007/0261850 | A1 | 11/2007 | Giroux et al. | |
| 2008/0011482 | A1 | 1/2008 | Badalamenti et al. | |
| 2008/0135248 | A1 | 6/2008 | Talley et al. | |
| 2008/0196889 | A1 | 8/2008 | Bour et al. | |
| 2008/0251253 | A1 | 10/2008 | Lumbye | |
| 2009/0071655 | A1 | 3/2009 | Fay | |
| 2009/0107675 | A1 | 4/2009 | Eriksen et al. | |
| 2009/0288838 | A1 | 11/2009 | Richards | |
| 2010/0163253 | A1 | 7/2010 | Caldwell et al. | |
| 2015/0330189 | A1 | 11/2015 | Themig et al. | |

FOREIGN PATENT DOCUMENTS

| | | |
|---|---|---|
| WO | WO 2009/040547 | 5/2005 |
| WO | WO 2009/132462 | 11/2009 |

OTHER PUBLICATIONS

Moore, Robert et al.; High Temperature Wells with Lost-Circulation Demands and Reverse Circulation Placement Technique Using Foamed Cement Systems: Two Case Histories; SPE Technical Conference and Exhibition, Denver, Colorado, USA, Oct. 5-8, 2003; SPE 84563.

Griffith, J. E. et al.; Reverse Circulation of Cement on Primary Jobs Increase Cement Column Height Across Weak Formations; SPE Production Operations Symposium, Oklahoma City, OK, USA, Mar. 21-23, 1993; SPE 25440.

Marriot, Tim et al.; Revers-Circulation Cementing to Seal a Tight Liner Cap; Offshore Technology Conference, Houston, Texas, USA, Apr. 30-May 3, 2007; OCT 18839.

Marquaire, R. et al., Primary Cementing by Reverse Circulation Solves Critical Problem in the North Hassi Messaoud Field, Algeria; Journal of Petroleum Technology, Feb. 1966; pp. 146-150; SPE111.

Davies, Jason et al.; Reverse Circulation of Primary Cementing Jobs—Evaluation and Case History; IADS/SPE Drilling Conference, Dallas, Texas, USA, Mar. 2-4, 2004; IADC/SPE 87197.

Michel, Charlie et al.; Reverse Circulation with Coiled Tubing—Results of 1600+ Jobs; SPE/ICoTA Coiled Tubing Conference and Exhibition, Houston, Texas, USA, Mar. 23-24, 2004; SPE 89505.

International Search Report for International Patent Application No. PCT/CA2010/001827, dated Feb. 9, 2011, 3 pgs.

International Preliminary Report on Patentability and Written Opinion for International Patent Application No. PCT/CA2010/001827, dated May 15, 2012, 6 pgs.

Office Action for Canadian Patent Application No. 2,778,720, dated Aug. 18, 2016, 3 pgs.

Office Action for U.S. Appl. No. 13/501,539, dated Oct. 6, 2014, 12 pgs.

Office Action for U.S. Appl. No. 14/808,167, dated Jul. 15, 2016, 8 pgs.

Notice of Allowance for U.S. Appl. No. 14/808,167, dated Dec. 23, 2016, 5 pgs.

* cited by examiner

STAGE TOOL FOR WELLBORE CEMENTING

CROSS REFERENCE TO RELATED APPLICATIONS

This application is a continuation of, and claims a benefit of priority under 35 U.S.C. 120 of the filing date of U.S. patent application Ser. No. 14/808,167 filed Jul. 24, 2015, which is a continuation of, and claims a benefit of priority under 35 U.S.C. 120 of the filing date of U.S. patent application Ser. No. 13/501,539 filed Apr. 12, 2012, issued as U.S. Pat. No. 9,121,255 on Sep. 1, 2015, which is a 371 of international application PCT/CA2010/001827 filed Nov. 12, 2010, which claims the benefit of priority under 35 U.S.C. § 119 to U.S. Provisional Patent Application No. 61/261,165 filed Nov. 13, 2009, the entire contents of which are hereby expressly incorporated by reference for all purposes.

FIELD

The invention relates to a tool for wellbore operations and, in particular, a stage tool for wellbore cementing.

BACKGROUND

In wellbore operations, cementing may be used to control migration of fluids outside a liner installed in the wellbore. For example, cement may be installed in the annulus between the liner and the formation wall to deter migration of the fluids axially along the annulus.

Often cement is introduced by flowing cement down through the wellbore liner to its distal end and forcing it around the bottom and up into the annulus where it is allowed to set. Occasionally it is desirable to introduce cement into the annulus without pumping it around the bottom end of the liner. A stage tool may be used for this purpose, which allows cement to be introduced to the annulus along the length of the liner.

SUMMARY

In accordance with a broad aspect of the present invention, there is provided a stage tool for wellbore annular cementing, comprising: a main body including a tubular wall with an outer surface and a longitudinal bore extending from a top end to a bottom end, the tubular wall including a first tubular and a second tubular telescopically secured relative to and axially slidable along the first tubular; a fluid port through the tubular wall and, when opened, providing fluidic access between the longitudinal bore and the outer surface, the fluid port being openable with the first tubular and the second tubular are a first overlapping position and being closed by axially sliding the first tubular and the second tubular into a further overlapping position relative to the first overlapping position; and a sliding sleeve valve positioned over the port and drivable by fluid pressure from a position sealing against fluid flow out of the tool from the fluid port and a position retracted from the fluid port to permit fluid flow out of the tool from the fluid port.

In accordance with another broad aspect, there is provided a method for stage cementing a wellbore annulus, the method comprising: running into a wellbore toward bottom hole with a tubing string to a position in the wellbore; setting the tubing string in the wellbore to create the wellbore annulus between the tubing string and a wall of the wellbore; pressuring up the tubing string inner diameter to shift a hydraulically actuated sleeve of a stage tool to open a cementing port at a position spaced from the distal end; pumping cement through the cementing port; and closing the cementing port by setting down an upper section of the tubing string relative to a lower section of the tubing string to compress the stage tool to drive a portion of the stage tool to overlap and close the cementing port and hold the cement in the annulus.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1A:
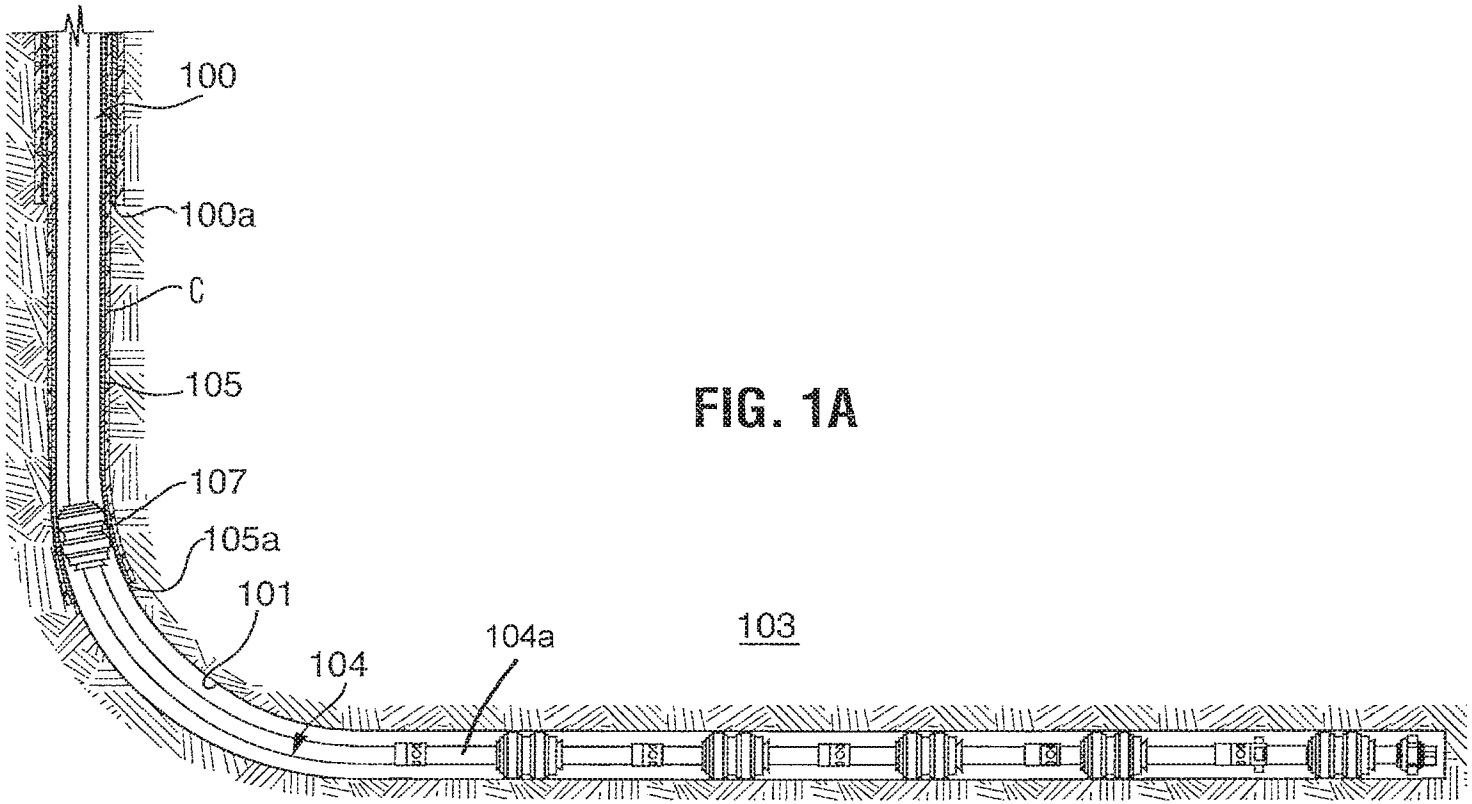
FIG. 1A (Prior Art)
FIG. 1A is schematic sectional view through a prior art wellbore with a tubing string installed therein.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

In wellbore operations, for example, as shown in FIG. 1, generally a surface hole is drilled and surface casing 100 is installed and cemented in place to protect surface soil and ground water from wellbore operations and to prevent cave in. Thereafter, an extended wellbore 101 is drilled, below the surface casing point 100*a*, to reach a formation of interest 103. Where operations are to be conducted using a liner 104, in prior art operations, as shown in FIG. 1A, often the extended wellbore is also cased (i.e. lined with one or more casing strings 105) and often cemented, by introduction of cement C into the annulus, to provide well control and isolation down to the liner. The liner is then set, as by use of a liner hanger 107 secured against the cased section of the well. The active, lower portion 104*a* of the liner may extend in the casing and/or out beyond the casing point 105*a* at the bottom of the cased section of the well. As will be appreciated by those skilled in the art, any time the well must be cased and cemented below the surface casing; significant financial and time costs are added to the operation. Also, the introduction of various cased sections decreases the available inner diameter space for the liner. In particular, the permissible OD of any liner becomes smaller, as the number of casing installations increases.

Figure 1B:
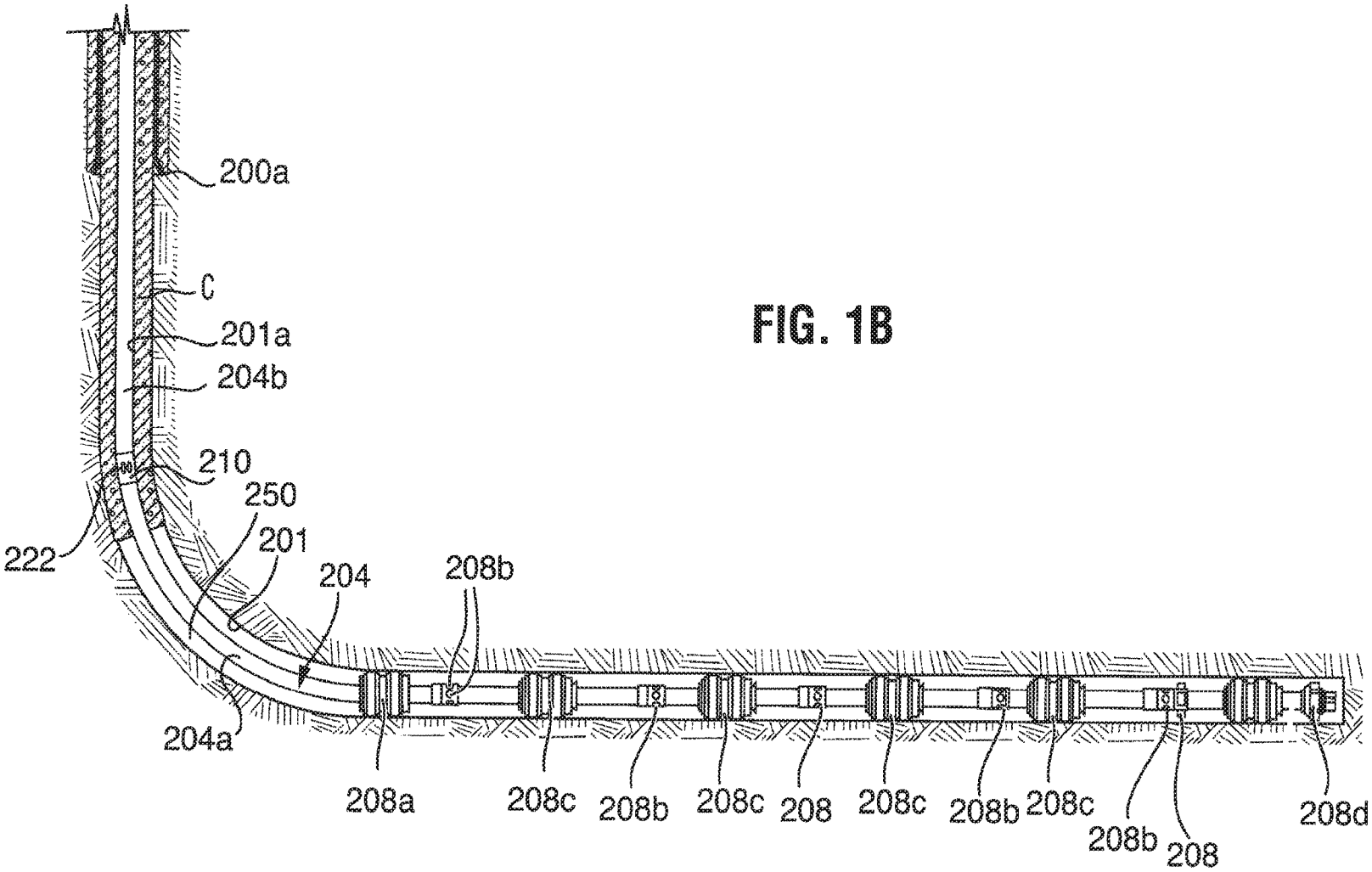
FIG. 1B is schematic sectional view through a wellbore with a tubing string installed therein.

According to the current invention, with reference to FIG. 1B, a process and installation are suggested that permit a liner 204 to be supported in an extended wellbore 201 by stage cementing below any casing point 200*a* of surface casing, as shown, or possibly below a casing point of a lower section of casing. The liner, therefore, can be installed by cementing the annulus about the liner in an open hole, uncased section of the well. The liner 204 has installed therein a stage tool 210, which separates the string into an upper portion 204*b*, above the stage tool, and a lower portion 204*a*, below the stage tool, containing active components 208 of the liner. Cement C may be introduced along the length of the liner at the position of the stage tool to cement, and therefore seal off, the annulus 250 between the liner and the open hole wall 201*a* above the stage tool. The cement may be introduced to fill a selected portion of the annulus, for example, to create a column extending back to the lowest cased section of the well.

Active components 208 may take various forms such as, for example, selected from one or more of packers, slips, stabilizers, centralizers, fluid treatment intervals (such as may include fluid treatment ports, nozzles, port closures, etc.), fluid production intervals (such as may include fluid inflow ports, screens, inflow control devices, etc.), etc. For example, in one embodiment active components 208 may include slips 208*a*, multistage fracturing components, sleeve valves, hydraulic ports 208*b*, packers 208*c* for zone isolation, blow out plugs, 208*d*, etc. Various of these are described in applicant's patents such as U.S. Pat. No. 6,907,936, issued Jun. 21, 2005 and U.S. Pat. No. 7,108,067, issued Sep. 19, 2006.

The liner may be run in and positioned in the well by various procedures. In one embodiment, the liner is run into a selected position and set by slips and/or packers in the well. In one embodiment, for example, after the liner is run in, a ball is launched to close the liner such that it can hold pressure. Alternately, the liner may be run in with a blow out plug already permitting the liner to hold pressure. Alternately, the liner may include a port opened by pressure cycling, such that once downhole, the liner can be pressured up and pressure released to open the liner. An example of such a pressure cycle valve is shown in applicant's corresponding application WO 2009/132462, published Nov. 5, 2009.

Thereafter or during the pressure manipulation process which opens the liner, the liner is pressured up to set the packers and/or slips.

Stage tool 210 includes one or more ports 222 that may be opened to permit cement to flow out therethrough. The opening operation may be achieved in various ways. In one embodiment, port opening occurs by hydraulics, as by bursting or pressure driven closures such as gates or sleeves. Alternately, the opening operation may be accomplished by mechanical means such as by landing a plug to actuate the tool or by liner manipulation such as rotating the string, placing the string in tension or compression or actuation of closures, as by sleeve shifting. Redundant features such as redundant ports and/or redundant closures may be employed to ensure port opening. For example, in one embodiment, a redundant sleeve may be provided wherein at least two sleeves are provided in the stage tool, each covering one or more ports. The sleeves are each pressure moveable and set with shear stock, such as screws, pins, etc., that can be overcome with internal pressures at a selected level. The shear stock for each sleeve may be selected to be shearable at substantially the same pressure as that of the other sleeve, but may be of a different rating or from a different source such that any risk of a non-opening sleeve by deficient stock is eliminated by redundancy. Such a redundant sleeve is described in greater detail in applicant's prior U.S. Pat. No. 7,762,333, issued Jul. 27, 2010.

After the stage tool's circulation ports are opened, cement may be pumped therethrough into the annulus. In one embodiment, a spacer is pumped first, followed by a cement slurry, another spacer and finally a displacement fluid. After introduction of cement to the annulus, it may be held in the annulus until it sets. While various means may be employed to maintain the cement in the annulus, generally the stage tool includes or works with a closure that closes the ports. The stage tool and closure may take various forms. For example, the stage tool may include a mechanical closure installed thereon that can be manipulated to seal off ports 222. Alternately, the stage tool may operate with plugs that are launched to close off the ports.

A stage tool that operates by the launching of plugs may include ports that are openable by some operation, such as using mechanically or hydraulically actuated mechanisms. Once the ports are opened, cement can be pumped down into the stage tool and out through its ports to the annulus. A spacer can then be pumped followed by displacement fluid. The stage tool may further include a plug landing mechanism, wherein a plug is launched to land in the stage tool to actuate a port closing mechanism. However, to avoid the problems that may occur by a pressure lock adjacent the stage tool, the stage tool may include a driver for the port closure such that when actuated by arrival of the plug, the driver takes over to fully close the port. For example, the port closure may include a plug stop and when the plug reaches the plug stop, it actuates the driver of the port closure, which will take over to drive the closure over the port. The driver can employ a spring mechanism, an atmospheric chamber, a pressure chamber, etc. In this embodiment, therefore, the plug need only land at the stage tool and the closing force to close the ports would be applied by a driver installed in the stage tool, such as a hydraulic or atmospheric chamber or a spring.

A stage tool including at least a mechanical closure may overcome some of the problems inherent in plug-based stage tools, which include the pressure locks that can occur, limiting downward movement of the plugs in the string and the requirement to remove the plugs to open the liner. In one stage tool, for example, the opening and/or closing of the cement ports may be controlled by manipulation of the liner from surface. If manipulation of the liner employs differential movement between upper and lower portions of the stage tool, the lower portion of the stage tool may be stabilized against movement, while the upper portion of the stage tool is manipulated directly or indirectly from surface. In one embodiment, the lower portion of the stage tool is stabilized against movement by stabilizing lower portion 204*a* of the liner by setting slips 208*a*, setting packers 208*c*, setting the liner against bottom hole (the distal end of the borehole in which the liner is positioned), etc. or various combinations thereof.

In one embodiment, manipulation includes rotating to open ports. In one embodiment, for example, the stage tool includes parts separated by a lubricity device such as a bearing to permit rotation to move gates away from and over ports 222. In another embodiment, the stage tool may include threads that, through rotation, may act to unthread and separate portions of the stage tool to open ports. Once the ports are opened, cement can be pumped down into the stage tool and out through its ports to the annulus 250. Non-setting displacement fluid can then be pumped to clear the inner diameters of the string and the stage tool of cement and then the ports may be closed. The stage tool ports may be closed mechanically, by reverse or continued rotation to continue to drive the parts along a threaded interval to close the gates. Lubricity devices such as bearings, for example thrust bearings, may be provided to accommodate compressive loading. For example, a lubricity device may be provided in the string to allow rotation of the string when in compression to arrive at the release position.

In another mechanically operated stage tool, the rotation can be combined with straight axial motion (i.e. applying tension or compressive forces) to open and/or close the ports of the stage tool. In one embodiment, for example, the stage tool may include threads that may be unthreaded to bring the upper and lower portions of the stage tool into a release position. The ports may be opened by applying tension, as by pulling upwardly on the stage tool to separate the parts to expose ports and, when desired to close the ports, the portions of the stage tool may be compressed, as by setting the upper portion down on the lower portion, to return the ports to the closed position. When the stage tool is closed by compression, a locking device may be employed to secure the parts together, when compressed. The locking device may be selected with consideration as to the pull strength (i.e. tensile strength) that may be required either during run in or after cementing. For example, liners that are to later act as conduits for fluid treatment operations may undergo considerable tensile loads. In one embodiment, for example, the stage tool may have an enlarged bearing surface over other devices by inclusion of a plurality of expandable segments releasing from one or more sets of threads or threaded devices. When released from their initial threaded condition, the segments may move into a retracted position, as by spring loading. As such, when threaded out, the segments may act as a solid threaded, but when the stage tool parts are brought together again, the threads push them against the spring and which allows them to move out. The engaging threads may ratchet through these and when they ratchet through, several sets of threads may engage together, for example, at substantially the same time. Such a mechanism provides considerable tensile strength.

Of course, any time the liner is manipulated by rotation; consideration should be given to avoid backing off of any threaded connections in other components of the string. As such, threads or rotating parts in the stage tool may be formed such that any torque or range of motion required to actuate them, particularly in the left hand direction when viewed from the top, must be significantly less than that required to unthread the liner components. As such, rotations required to open and/or close the stage tool ports may be limited to only rotation in the right hand direction, when view from the top (i.e. employing left hand threads), and/or limited to manipulations requiring less than 15, less than 10 or possibly even less than 5 complete turns.

In yet another mechanically operated stage tool, axial motion (i.e. applying tension or compressive forces) to open and/or close the ports of the stage tool may be combined with hydraulics to open or close the circulation port.

Figure 2A:
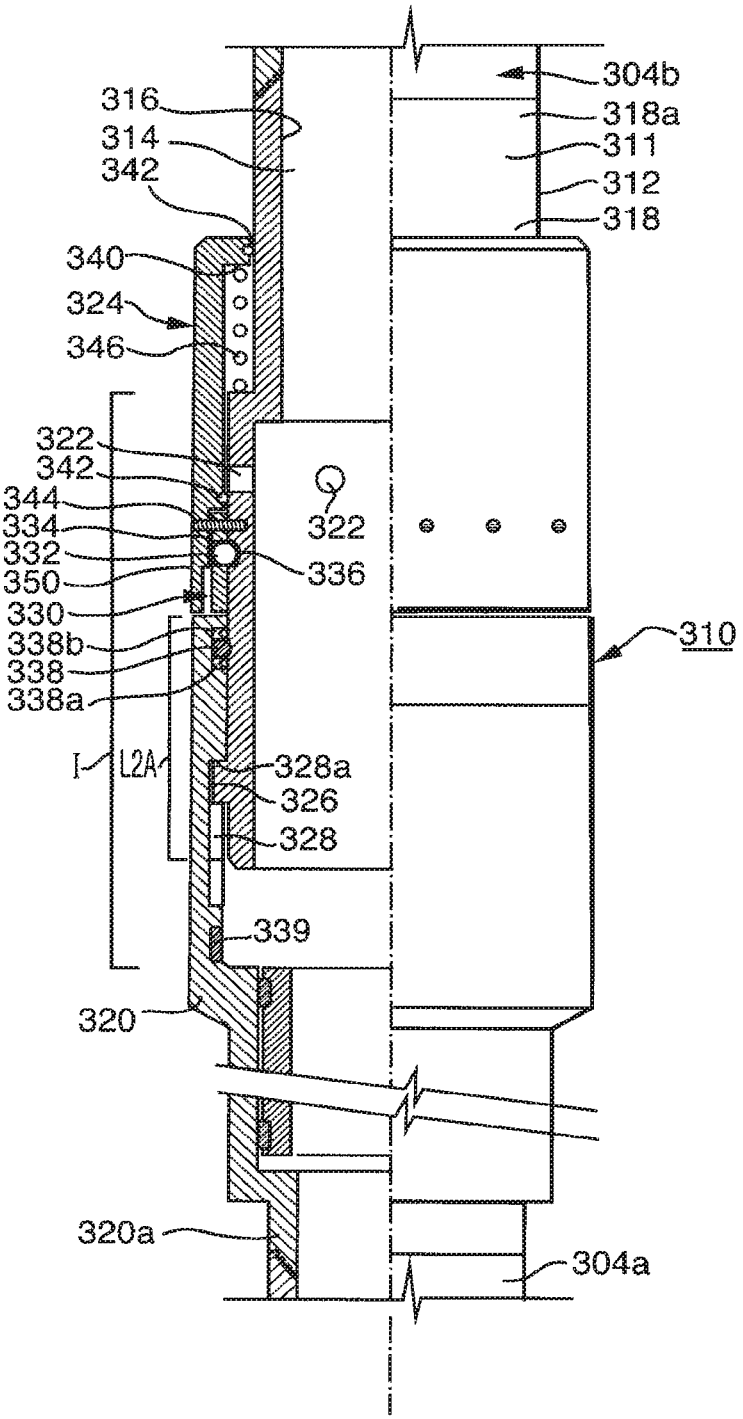
FIGS. 2A, 2B and 2C are axial sectional views of a stage tool in first, second and third positions, respectively, according to one aspect of the present invention.
Figure 2B:
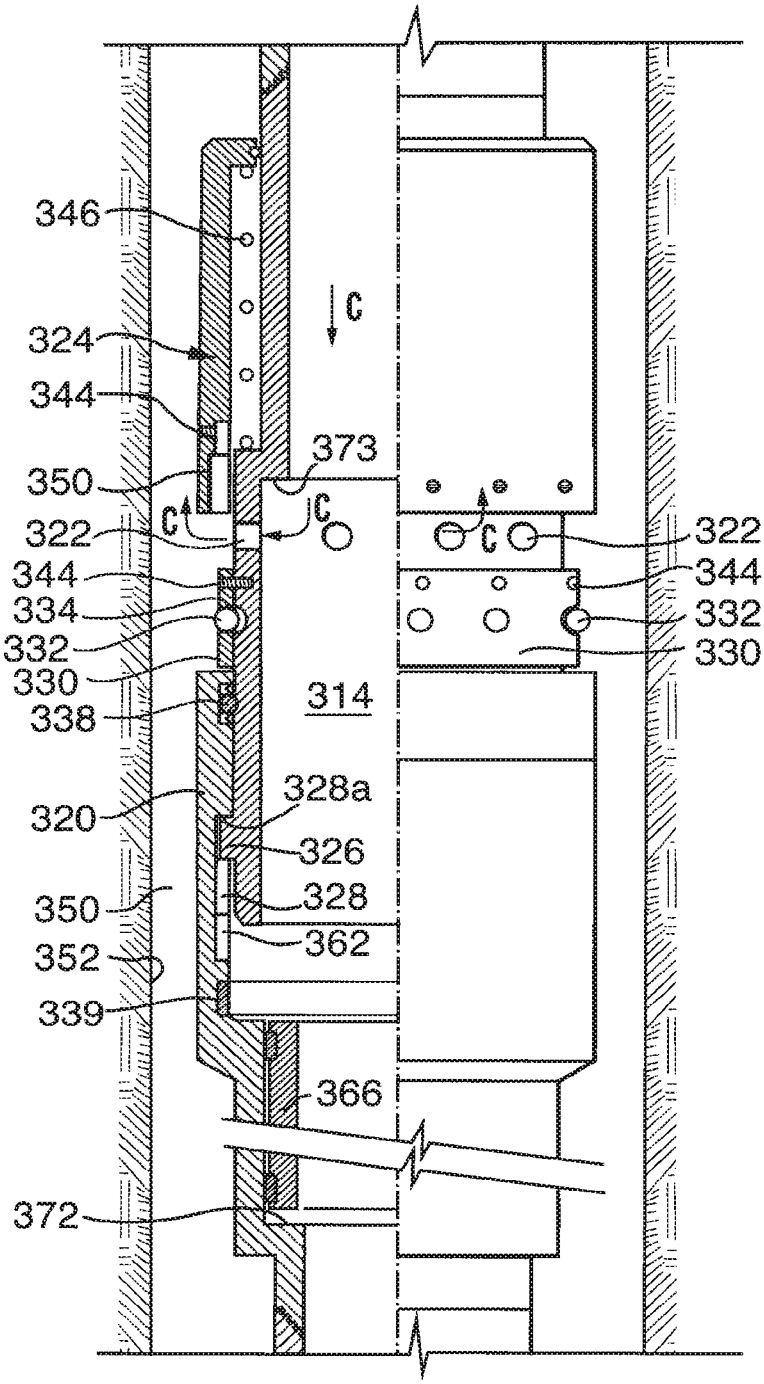
Figure 2C:
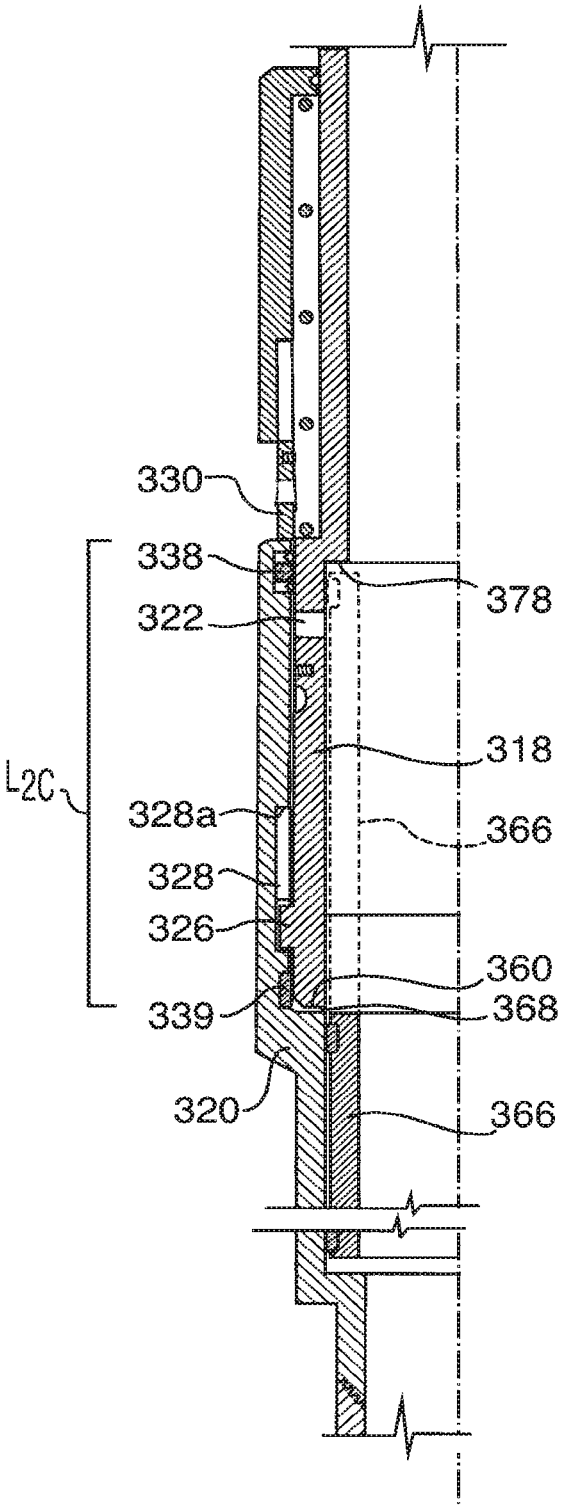

Referring to FIG. 2, a stage tool 310 for installation in a wellbore liner is shown. Stage tool 310 may include a tubular body including a wall 311 with an outer surface 312, an inner bore 314 defined by an inner surface 316 of the wall, a first end 318 and a second end 320 telescopically arranged for slidable movement along an interval I of the first end and the second end, a port 322 extending through the wall in the interval in a position to be openable in one overlapping position (FIG. 2B) of the first part and the second part and to be closeable in another overlapping position (FIG. 2C) of the first part and the second part, and a sleeve 324 positioned to act as a removable closure for the port.

Stage tool 310 may be intended for use in wellbore applications for actuation to permit cementing of a section of the annulus behind a borehole liner along the length of the liner. The tubular body may be formed of materials useful in wellbore applications such as of pipe, liner, casing, etc. and may be incorporated as a portion of a tubing string. Bore 314 may be in communication with the inner bore of a tubing string such that pressures may be controlled therein and fluids and tools may be communicated from surface, such as for wellbore treatment therethrough. The tubular body may be formed in various ways to be incorporated in a tubular string. For example, the tubular segment may be formed integral or connected by permanent means, such as welding, with another portion of the tubular string. Alternately, the ends 318*a*, 320*a* of the tubular body may be formed for engagement in sequence with adjacent tubulars in a string. For example, the ends may be formed as threaded pins or boxes to allow threaded engagement with adjacent tubulars.

Stage tool 310 may be manipulated between a plurality of positions. As shown by the drawings, the stage tool may be manipulated between a first, run in position (FIG. 2A), a second, cementing position (FIG. 2B) and a third, closed position (FIG. 2C). The overlapping length L of the first part and the second part may vary and the position of the sleeve 324 may change in these various positions. For example, the position of FIG. 2C has a greater overlapping length $L_{2C}$ than the overlapping length $L_{2A}$ of FIG. 2A.

First part 318 and second part 320 are each tubularly formed and together form the tubular body. Inner bore 314, for example, extends through both parts. Parts 318, 320 are telescopically arranged and overlap along a portion of interval I and are slidable when freed to do so to adjust their overlapping length. From the drawings, it is shown that the overlapping length of the parts 318, 320 vary as the tool moves from the second (open for cement circulation) and third (closed) positions. Although first part 318 is shown above the second part, it is to be understood that the tool can be inverted. Also, although the first part is shown overlapped by second part 320, the overlapping arrangement could be opposite with the first part encircling the second part along the overlapping interval.

While capable of telescopic, sliding movement therebetween, first part 318 and second part 320 are held together such that they cannot be pulled fully apart. Various connections can be employed such as a protrusion that rides in and is captured in a groove on the other part. In the illustrated embodiment for example, such a protrusion/groove arrangement is provided by a slot and a key on the parts such that a key on one part rides in and cannot escape from a slot on the other part. An end wall on the slot prevents the key from passing out of the slot, thus preventing the parts from being pulled apart. For example in the illustrated embodiment, first part 318 includes a key 326 thereon along the overlapping interval I, which rides in a slot 328 on the second part. The form of slot 328 can control the degree to which, and, if desired, the path through which, part 318 can move relative to part 320. To provide greater strength in tension, a plurality of interacting keys and slots may be provided, spaced about the circumference of the parts in the overlapping interval.

The movement of parts 318, 320 into greater overlapping arrangement can also be controlled such that any sliding movement between the parts can occur only when permitted. For such a purpose, a releasable locking mechanism may be provided between the parts. In one embodiment, for example, one or more of shear pins, dogs, a load ring, detents, a c-spring or other releasable locking mechanisms may be employed. In some embodiments, it is desirable to select a releasable locking means that can be overcome to allow movement of the parts only after a preliminary event has occurred. In the illustrated embodiment, for example, a load ring 330 is employed that is positioned to block movement of the parts 318, 320 into greater overlapping relation and is locked in place in such a way that it can be moved only after certain events have occurred. While the mechanism of operation will be better understood by reference to description herein below, the load ring in the illustrated embodiment may be locked in place by one or more lock structures 332 that are engaged in aligned detents 334, 336 in each of the load ring and the body of the tubular member. Structures 332 may be formed as pins, balls, rods, c-shaped bodies, etc. When structures 332 are secured against movement out of aligned detents 334, 336, load ring 330 cannot move out of this set position. However, when the structures are free to move out of either detent 334 or 336, the load ring can slide along the tubular body wall. Structures 332 may include a rounded exterior shape on their leading edges to facilitate movement out of locking position. For example, in one embodiment structures 332 are formed as spherical balls and detents 336 are also rounded to enhance movement of the structures out of the detents, when they are free to move.

One or more seals 338, 339 may be provided in the interval to deter fluid leakage to/from inner bore 314 between the parts. It will be appreciated, that annularly extending seals may be particularly useful. Seals 338, 339 may take various forms and be formed of various materials, such as, for example, various combinations of elastomerics, metals, rings, o-rings, chevron or v-seal stacks, wiper seals, etc. If any seals must pass over contoured surfaces such as ports or glands, consideration may be given to the form and durability of the seal. For example, seal 338 during operation of the tool may pass over port 322, which may have sharp edges, yet continue to be required to act in a sealing capacity between parts 318, 320. Seal 338 may, in one embodiment therefore, be bonded in its gland 338*a*, such that it cannot easily be pulled or dislodged therefrom. Alternately or in addition, seal 338 may be selected to include a stack of chevron seals 338*b*, the seals being formed each with a V-shaped cross section, as these seals may have a resistance to dislodging from their glands and resistance to damage greater than those of o-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), etc.

Port 322 is provided through the tubular body wall in the interval I in a position to be open in one overlapping position of the first part and the second part and to be closeable in another overlapping position of the first part and the second part. In the illustrated embodiment, port 322 is formed through the first part, but could alternately be formed through the second part.

The stage tool further includes a removable closure for the port such that the port can be closed against fluid flow therethrough and selectively opened when it is appropriate to do so. In the illustrated embodiment, sleeve 324 acts as the removable closure. Sleeve 324 may be installed on the tool to act as a piston, in other words to be axially moveable relative to the tubular segment at least some movement of which is driven by fluid pressure. Sleeve 324 may be axially moveable through a plurality of positions. For example, as presently illustrated, sleeve 324 may be moveable from a port closing position covering the port (FIG. 2A) to a port open position (FIG. 2B), not covering the port. The installation site for the sleeve in the tubular segment is formed to allow for such movement.

Sleeve 324 may include a piston face 340 in communication, for example through port 322 and gap 341, with the inner bore 314 of the tubular body such that piston face 340 is exposed to tubing pressure. The other side of the sleeve is in communication with the outer surface 312 of the tubular body and therefore open to annulus pressure. As such, a pressure differential can be set up at piston face 340 by increasing tubing pressure to move the sleeve. Piston face 340 is positioned such that a pressure differential drives the sleeve away from its port closing position to its port open position.

Seals 342 may be provided to limit leakage from inner bore 314 past the sleeve, when it is in the port closing position. It will be appreciated, that annularly extending seals may be particularly useful. Seals 342 may take various forms and be formed of various materials, such as, for example, various combinations of elastomerics, metals, rings, o-rings, chevrons, wiper seals, etc.

One or more releasable setting devices 344 may be provided to releasably hold the sleeve in the port closing position. Releasable setting devices 344, such as one or more of a shear pin (a plurality of shear pins are shown), a collet, a c-ring, etc. provide that the sleeve may be held in place against inadvertent movement out of any selected position, but may be released to move only when it is desirable to do so. In the illustrated embodiment, releasable setting devices 344 may be installed to maintain the sleeve in its port closing position but can be released, as in the present embodiment by shearing, by differential pressure across face 340 to allow movement of the sleeve. Selection of a releasable setting device, such as shear pins to be overcome by a pressure differential is well understood in the art. In the present embodiment, the rating and number of shear pins may be selected with reference to the tubing pressure that is desired to be applied to move the sleeve.

If desired, a driver 346 may be provided to assist movement of the sleeve into the port open position. The driver may be selected to be unable to move the sleeve until releasable setting devices 344 are released. Since driver 346 is unable to overcome the holding power of releasable setting devices 344, the driver can only move the sleeve once the releasable setting devices are released. Since driver 346 cannot overcome the holding pressure of releasable setting devices 344 but the differential pressure can overcome the holding force of devices 344, it will be appreciated then that driver 346 may apply a driving force less than the force exerted by the differential pressure such that driver 346 may also be unable to overcome or act against a differential pressure sufficient to overcome devices 344. Driver 346 may take various forms. For example, in one embodiment, driver 346 may include a spring and/or a gas pressure chamber to apply a push or pull force to the sleeve. In the illustrated embodiment, driver 346 employs a spring biased to drive the sleeve along the tubular body away from the port closing position when the sleeve is freed to move.

Sleeve 324 may be installed in various ways on or in the tubular segment and may take various forms, while being axially moveable along a length of the tubular segment. For example, as illustrated, sleeve 324 may be installed on the outer surface but, again, its position may be selected, as desired.

It is noted that sleeve 324 in the illustrated embodiment, acts to lock the load ring in position. In particular, in this illustrated embodiment, an extension 350 of the sleeve overlies detents in the load ring to secure structures in place in aligned detents. As such, sleeve 324 when in the port closing position, extends over detents 334, 336 to lock structures 332, and thereby the load ring, in place. When sleeve 324 moves to the port open position, the structures are free to move out of their locking position spanning detents 334, 336 and the load ring can move when force is applied thereto.

Having thus described the components of the example stage tool 310, the operation of that stage tool will be described. The stage tool may be run into and set in the hole in a condition as shown in FIG. 2A and may be manipulated to a condition shown in FIG. 2B for stage cementing. After the introduction of cement, the tool may be manipulated to a condition shown in FIG. 2C to close off communication between the annulus and the inner bore of the tool.

In summary, the stage tool, installed in a tubing string, will be run into the wellbore with the port closed by a removable closure and with the overlap of parts 318, 320 retracted from blocking the port. Once in position, port 322 is opened, as by actuation of the removable closure to open, to provide fluid communication from inner bore 314 to an annulus to be cemented between the tool and the wellbore wall. Cement is then introduced to inner bore 314 which flows out through ports 322 into the annulus. When sufficient cement is introduced, the parts 318, 320 are slid along the interval I, to adjust their overlap to block fluid flow through port 322. This, then, holds the cement in the annulus and time is allowed for the cement to set.

For example, for use, the tool is installed in a tubular string with its inner bore 314 in communication with the inner diameter of the tubing string. In preparation for use, parts 318 and 320 are secured together such that they cannot be pulled apart, for example by shouldering of key 326 against end wall 328*a* of the slot. The parts overlap along interval I and are locked in position by a releasable locking mechanism. In the illustrated embodiment, releasable locking is provided by load ring 30 which is held by structures 332 engaged in detents 334, 336 in the ring and the tubular body, respectively. Structures 332 cannot move out of an engagement position spanning these detents due to a portion of sleeve 324 overlying detent 334. The parts overlap in such a way that, if unlocked, movement into further overlapping relation can be achievable. In other words, there is space to accommodate advancement of the parts into a greater overlapping length, but the parts are locked against such movement. Also, the overlapping parts are spaced from blocking port 322. In addition, a removable closure covers port 322 such that fluid leakage through the port out of bore 314 is deterred. In this illustrated embodiment, sleeve 324 is positioned as the removable closure and releasably set in a port closing position by shear pins 344.

The string, including tool 310, is then run into the wellbore. Generally, the string will be run in until the stage tool is positioned in an uncased portion of the well wherein an annulus 350 is formed between outer surface 312 and an open hole wall 352. The tubing string may remain supported at surface, either directly or indirectly, such that weight on the string can be adjusted. If necessary, the string inner diameter including bore 314 and annulus 350 below port 322 may be sealed as by filling with high density liquid and/or by installation of plugs or packers to deter cement from passing beyond a selected distance below port 322. In one embodiment, for example, a packer may be set in the annulus and high density liquid may be introduced to the tubing string.

Once the tubing string is positioned, port 322 may be opened. The port may be opened, for example, at least when it is desired to initiate a cementing operation through stage tool. However, in some cases, port 322 may be opened earlier, for example, where fluid is required for circulation or introduction of fluids to the annulus. To open port 322, the removable closure is removed from the port. Once opened, fluid communication is opened through port 322 from inner bore 314 to outer surface 312 and, in particular, annulus 250 (FIG. 1B). In the drawings, the removable closure is embodied by sleeve 324. Sleeve 324 is removed from its covering position over port 322 by fluid pressure applied against piston face 340. The fluid pressure may be increased from surface and communicated to bore 314, for example, through the tubing string extending thereabove. Once fluid pressure is increased to a sufficient level to overcome the holding strength of devices 344, the sleeve can move away from its covering position over port 322. To facilitate and enhance movement, sleeve 324 can be driven by spring 346. In view of the orientation of the sleeve, in certain applications where the tool is a more generally vertical position, the spring may also be useful to prevent the sleeve from falling by gravity back down over port.

Where the illustrated tool is employed in a string having other fluid pressure actuated components, the driving pressure of the sleeve should be selected with consideration as to the other components to be actuated and if they need be actuated before or after the sleeve. For example, the sleeve may be selected to only move at pressures greater than the pressures required to move components that must be moved earlier in the tubing string handling, such as, for example, may include packers, slips, etc.

Port 322, being opened to fluid passage therethrough, permits cementing of the annulus. The cement, arrows C, may be pumped from surface to bore 314 and out through ports 322, for example, through the tubing string 304*b* extending thereabove. Introduction of cement continues, as desired, until a suitable volume has been introduced.

During this operation, it is noted that parts 318 and 320 are held in tension by support of the string above the tool. For example, parts 318 and 320 remain in position with key 326 adjacent end wall 328*a* of the slot. However, it will be noted that the movement of sleeve 324 away from port 322 also acts to remove sleeve extension 350 from over detent 334. As such, structure 332 is free to move out of engagement with detent 336 and load ring 330 is free to move if force is placed upon it.

When sufficient cement has been introduced, port 322 is closed to hold the cement in the annulus, thereby preventing U-tubing. To close port 322, the stage tool can be compressed to bring the overlapping length of parts 318, 320 to a position covering port 322 (FIG. 2C). To do so, the tubing string can be lowered from surface to drive parts 318, 320 to slide telescopically together into greater overlapping relation. The sliding movement may be guided and permitted by key 326 riding in slot 328. The sliding movement continues at least until the overlapping region covers port 322 and seal 38 passes over and seals port 322 from annulus 250. In this illustrated embodiment, port 322 is formed in first part 318 and the second part is moved to slide over and overlap with first part at least to a position covering the port. When the first part and the second part are in this overlapping position closing the port, seal 339 may also be employed. Load ring 330 and, if necessary, sleeve 324 are pushed along by the leading edge of part 320. These parts 330, 324, not being anymore fixedly secured against axial motion, simply advance as pushed along.

To facilitate the compression of the parts 318, 320, it may be useful to ensure that the string 304*a* below part 320 is held against slipping. As such, prior to compression, it may be useful to brace the string below the tool against axial movement in the well. If desired, therefore, slips can be set along the string and/or the string can be set against bottom hole. This may be accomplished by pressuring up the string.

When the first part and the second part are in this overlapping position closing the port, the string may still be supported to some degree at surface. Alternately, the weight of first part 318 and the tubing string above it may be set down on key 326 against an opposite end wall of the slot and/or on shoulder 360 of second part 320.

Figure 3:
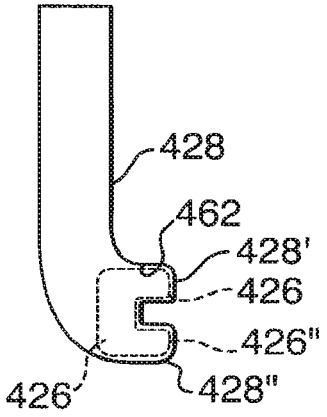
FIG. 3 is a plan view of a slot useful in the stage tool of FIG. 2.

If desired, slot 328 may be formed to provide resistance to re-separation of the first and second parts. For example, with reference to FIG. 3, a slot 428 may be formed to include a return 462 into which key 426 moves when the parts are slid together. In such an embodiment, slot 428 may be termed a J-slot. The return may provide an abrupt directional change along the slot into which the key must be forced, as by rotating the parts relative to each other. Alternately, the slot may undergo a gradual transition to the return such that the key will automatically be moved into the return when the key is slid along the slot. In one embodiment, such as the one illustrated, the key may be include multiple extensions 426', 426" and the slot may include a corresponding number return openings 428', 428" such that the interlock between the key and the slot occurs on several surfaces. This resists forces in tension tending to pull the parts apart.

If desired, a backup closing sleeve 366 may be carried by the tool to act as a backup seal against fluid leakage after the tool is collapsed. For example, sleeve 366 may be positioned and sized to close both the opening 368 of the interface between parts 318, 320 and port 322, which are the two paths through which leaks back into bore 314 may arise. Sleeve 366 may be moved along bore 314 by engagement with a pulling tool. An annular recess may be provided to permit sleeve 366 to be recessed out of the main ID of bore 314 and to provide stop walls 372, 373 against which the sleeve may be stored and stopped.

In the method, to facilitate reentry and/or fluid communication past tool 310, a chasing plug of liquid may be pumped just before the tool is collapsed. As such, it is likely that any fluid remaining in the string may be devoid of settable cement. The chasing plug may, for example, include retarder, water, etc.

Referring to FIG. 4, another stage tool 510 for installation in a wellbore liner is shown. The stage tool is opened for cement circulation therethrough by hydraulic actuation and is closed by manipulation of the drill string to compress a component of the stage tool to close the circulation port.

Stage tool 510 may include a tubular body including a wall 511 with an outer surface 512 and an inner bore 514 defined by an inner surface 516 of the wall. The wall of the body is formed by a first tubular part 518 and a second tubular part 520 telescopically arranged for slidable movement along an interval I. The stage tool further includes a port 522 extending through the wall in the interval in a position to be openable in one overlapping position (FIG. 4B) of the first part and the second part and to be closed in another overlapping position (FIG. 4C) of the first part and the second part, and a sleeve 524 positioned to act as a removable closure for the port.

Stage tool 510 may be intended for use in wellbore applications for actuation to permit cementing of a section of the annulus behind a borehole liner along a length of the liner. The tubular body may be formed of materials useful in wellbore applications such as of pipe, liner, casing, etc. and may be incorporated as a portion of a tubing string. Bore 514 may be in communication with the inner bore of a tubing string such that pressures may be controlled therein and fluids and tools may be communicated from surface, such as for wellbore treatment and tool actuation, therethrough. The tubular body may be formed in various ways to be incorporated in a tubular string. For example, the tubular segment may be formed integral or connected by permanent means, such as welding, with another portion of the tubular string. Alternately, the ends 518*a*, 520*a* of the tubular body may be formed for engagement in sequence with adjacent tubulars in a string. For example, although shown here as blanks, the ends may be formed as threaded pins or boxes to allow threaded engagement with adjacent tubulars.

Figure 4A:
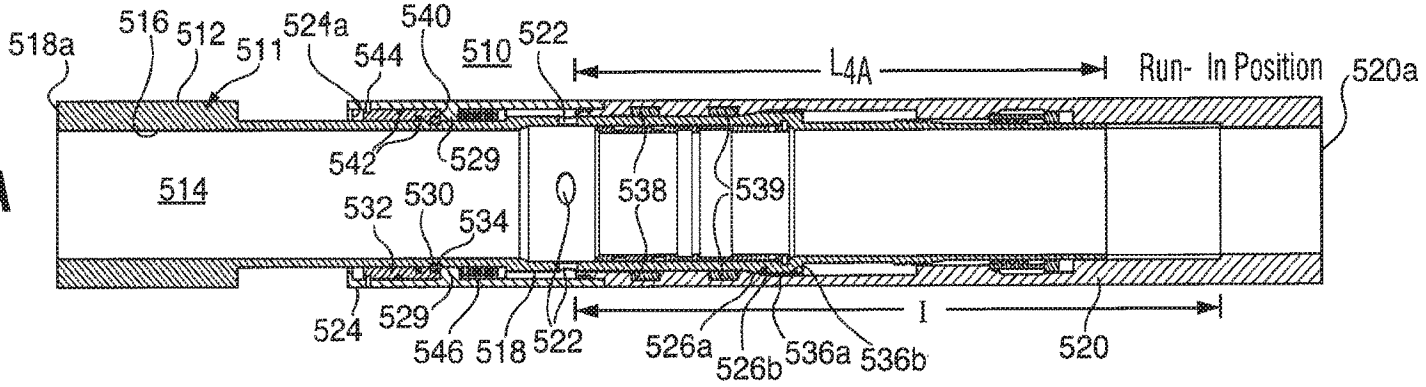
FIGS. 4A to 4E are axial sectional views of a stage tool in a run in, an open for cement circulation, a closed, an approaching re-opened and a re-closed, respectively, positions according to one aspect of the present invention.
Figure 4B:
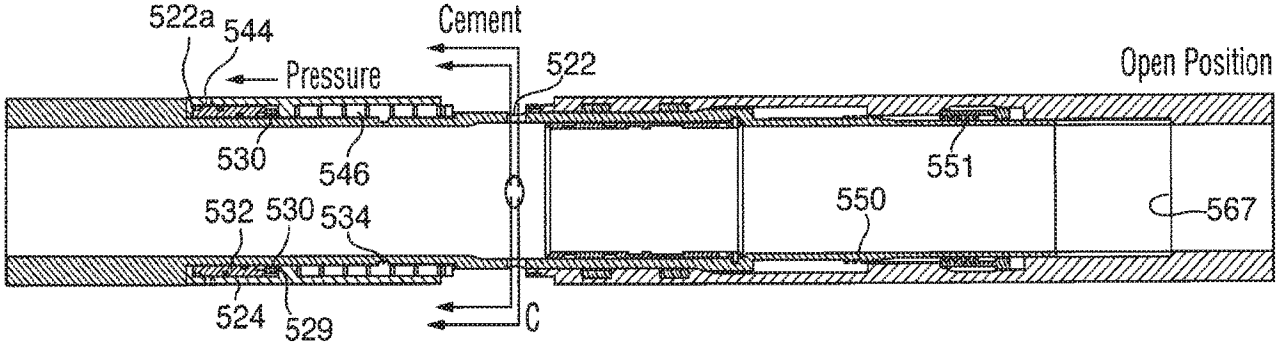
Figure 4C:
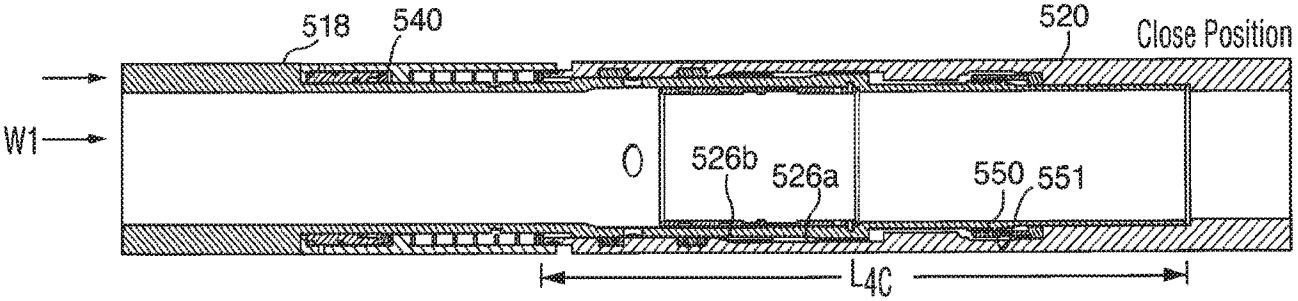
Figure 4D:
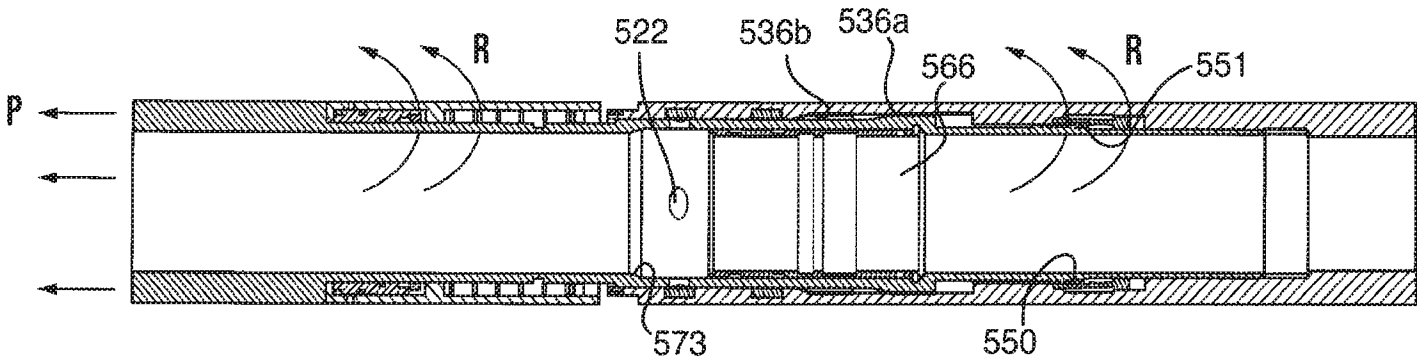
Figure 4E:
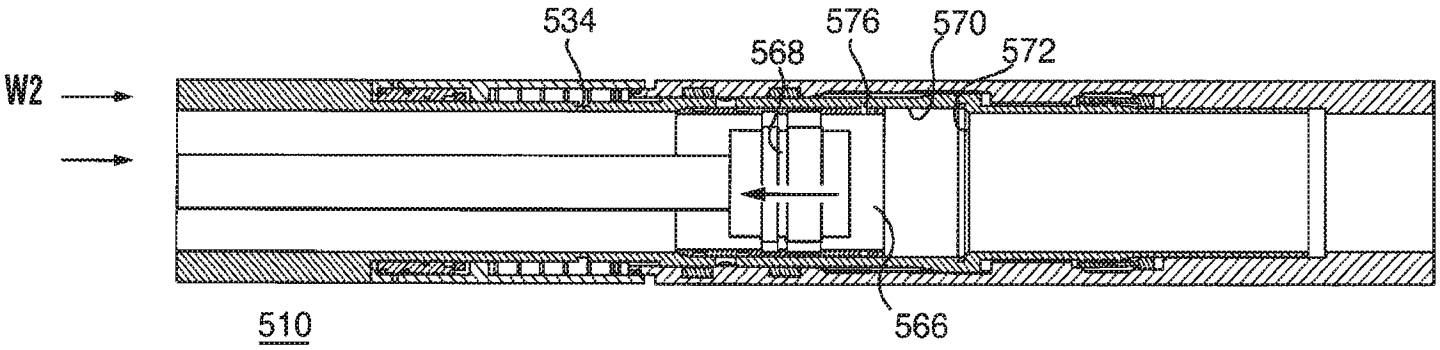

Stage tool 510 may be manipulated between a plurality of positions. As shown by the drawings, the stage tool may be manipulated between a first, run in position (FIG. 4A), a second, open cementing position (FIG. 4B) and a third, closed position (FIG. 4C). The stage tool may be further manipulated between a re-opened position and a reclosed positioned. FIG. 4D shows the tool moving toward the re-opened position and FIG. 4E shows the tool in the reclosed and safety sealed position.

The overlapping length L of the first part and the second part and the position of sleeve 524 may be varied to achieve these various positions. For example, the position of FIG. 4C has a greater overlapping length $L_{4C}$ than the overlapping length $L_{4A}$ of FIG. 4A and the position of sleeve in FIG. 4A is different than in FIG. 4B.

First part 518 and second part 520 are each tubularly formed and together form the tubular body. Inner bore 514, for example, extends through both parts. Parts 518, 520 are telescopically arranged and overlap along a portion of interval I and are slidable when freed to do so to adjust their overlapping length. From the drawings, it is shown that the overlapping length of the parts 518, 520 vary as the tool moves between the second and third positions. Although first part 518 is shown above the second part, it is to be understood that the tool can be inverted. Also, although the first part is shown overlapped by second part 520, the overlapping arrangement could be opposite with the first part encircling and overlapping the second part along the overlapping interval.

While capable of telescopic, sliding movement therebetween, first part 518 and second part 520 are held together such that they cannot be pulled fully apart. Various mechanisms can be employed to hold the parts together such as opposite, abutting shoulders. In the illustrated embodiment, for example, such a shoulder 526*a* is formed by an OD increase on the outer diameter of the first part and a corresponding shoulder 526*b* is formed by an ID tapering on the inner diameter of the second part such that shoulder 526*a* can ride along the inner diameter of the second part but butts against the shoulder 526*b* and cannot move therepast to escape from within the second part.

The movement of parts 518, 520 to vary the overlapping length can be controlled such that any sliding movement between the parts can occur only when it is permitted. In particular, the functioning of the tool relies on the overlap of the parts being variable but being releasably locked in some configurations to only permit axial movement therebetween when unlocked to do so. For such a purpose, a releasable locking mechanism may be provided between the parts. In one embodiment, for example, one or more of shear pins, dogs, a load ring, detents, or other releasable locking mechanisms may be employed. In some embodiments, it is desirable to select a releasable locking mechanism that can be overcome to allow movement of the parts only after a preliminary event has occurred. In the illustrated embodiment, for example, a load ring 530 is employed that is positioned to prevent movement of the parts 518, 520 into greater overlapping relation and is locked in place in such a way that it can be moved only after a preliminary release event has occurred. While the mechanism of operation will be better understood by reference to the description hereinbelow, the load ring is formed to act as a direct or indirect interlock between the parts 518, 520 to prevent at least one of their relative axial compression or axial extension and substantially cannot be overcome to permit axial movement until it is unlocked. The load ring acts by being engaged in the material of one of the parts, part 518 for example, and by protruding from its engaged position in part 518 to create a stepped structure past which part 520 cannot move axially. In the illustrated embodiment, the load ring interlocks between part 518 and sleeve 524, which is connected to part 520. Load ring 530 may be variously configured, such as in the form of a c-ring set in an annular groove, such as a gland, and normally biased outwardly but locked between the sleeve and the first part. In the illustrated embodiment load ring is a multipart structure, such as including two half rings, arranged to form a ring, set in a gland 534 with a portion protruding therefrom and able to fall out of the gland, unless held in the gland. In the illustrated embodiment, ring 530 is locked between the sleeve and the first part by a load ring lock structure 532. Load ring lock structure 532 is a ring formed to overlie the load ring and hold it in the annular gland 534 in the first part. When structure 532 is secured over the load ring, load ring 530 cannot move out of this set position in gland 534 such that the tool including parts 518, 520 is locked from axial compression. In particular, load ring 530 locks into gland 534 but includes a portion that extends out beyond the depth of the gland such that a step is created, past which structures, such as lock structure 532 and shoulder 529 on sleeve cannot move. However, when structure 532 is driven to move away from an overlying position relative to the load ring, load ring 530 parts can expand (i.e. fall or be pushed) out of the gland and slide along the tubular body wall without imparting further resistance to the movement of the parts. Load ring 530 and gland 534 may each include a chamfering on their leading edges to facilitate movement out of locking position, when they are freed by movement of structure 532.

Lock structure 532 may be driven by various means including hydraulics. In one embodiment, for example, lock structure 532 includes a piston face 540.

One or more releasable setting devices may be provided to releasably hold the lock structure 532 in its overlying position such that it isn't inadvertently shifted. For example, releasable setting devices 544, such as one or more of a shear pin (a plurality of shear pins are shown), a collet, a c-ring, etc. provide that the lock ring may be held in place against inadvertent movement out of any selected position, but may be released to move only when it is intended to do so. In the illustrated embodiment, releasable setting devices 544 may be installed to maintain the lock ring structure 532 in its overlying position over the load ring but can be released, as in the present embodiment by shearing, by differential pressure across face 540 to allow movement of the lock structure. In this embodiment, devices 544 include shear screws engaging the lock structure 532 to sleeve 524. However, the releasable setting devices could be installed to act between the lock structure and other parts, such as part 518. In the present embodiment, the rating and number of shear pins may be selected with reference to the pressure differential that is to be applied to move the lock structure.

It is noted that in this embodiment, load ring lock structure 532 also acts as a piston for other actuation procedures, as will be described further below.

The first part and the second part may also be formed to resist rotational movement therebetween, at least in some orientations. For example, in a run in position (FIG. 4A), it may useful to transmit torque through the tool such that the string below the tool can be rotationally manipulated. In such an embodiment, a lock against independent rotational movement can be provided between the first part and the second part which will lock up in at least some tool orientations. In the illustrated embodiment, for example, a section 536*a* along the first part and a section 536*b* along the second part are each correspondingly formed to fit together and ensure unified rotational movement therebetween. Sections 536*a*, 536*b* may be faceted, such as by splining, such that when the parts are aligned such as at FIGS. 4A and 4B, they will engage and ensure that any torque applied to one part 518 or 520 will be transmitted to the other. Torque can therefore be communicated through the string and the tool therein when sections 536*a*, 536*b* are axially aligned, such as at FIGS. 4A and 4B. If some differing relative rotation is of interest, sections 536*a*, 536*b* may be disconnected by moving them out of radial alignment, such as shown in FIGS. 4C and 4D.

One or more seals 538, 539 may be provided in the interval I to deter fluid leakage to/from inner bore 514 between the parts. It will be appreciated, that annularly extending seals may be particularly useful for this purpose. Seals 538, 539 may take various forms and be formed of various materials, such as, for example, various combinations of elastomerics, metals, o-rings, chevron or v-seal stacks, wiper seals, etc. In one embodiment, these seals may have to seal against back flow of cement from the annulus and, therefore, may have to resist considerable pressures. Consideration may be given to the form and durability of the seal. In one embodiment, redundant, bonded seals may be employed.

Port 522 is provided through the tubular body wall in the interval I in a position to be open in one overlapping position of the first part and the second part and to be closed in another overlapping position of the first part and the second part. In the illustrated embodiment, port 522 is formed through the first part, but could alternately be formed through the second part or could be ports through both parts that are aligned when open and out of alignment when closed.

The stage tool further includes a removable closure for the port such that, even when the port is not closed by the overlapping parts, the port can be closed against fluid flow therethrough and selectively opened when it is appropriate to do so. In the illustrated embodiment, sleeve 524 acts as the removable closure. Sleeve 524 may be installed on the tool to act as a piston, in other words to be axially moveable relative to the tubular segment at least some movement of which is driven by fluid pressure. Sleeve 524 may be axially moveable through a plurality of positions. For example, as presently illustrated, sleeve 524 may be moveable from a port closing position covering the port (FIG. 4A) to a port open position (FIG. 4B), not covering the port. The installation site for the sleeve in the tubular segment is formed to allow for such movement.

Sleeve 524 may be driven by hydraulics and includes a piston face 540 in communication, for example through port 522, with the inner bore 514 of the tubular body such that piston face 540 is exposed to tubing pressure. The other side of the piston is in communication with the outer surface 512 of the tubular body and therefore open to annulus pressure. As such, a pressure differential can be set up across the piston face 540 by increasing tubing pressure, while that tubing pressure is substantially isolated from communication to the annulus. This pressure differential across the piston face can be used to generate force to move the sleeve and open the port 522 to fluid flow therethrough. Piston face 540 is positioned such that a pressure differential drives the sleeve away from its port closing position to its port open position. In the illustrated embodiment, piston face 540 is not rigidly connected to sleeve 524 but acts to move the sleeve by butting against an inwardly extending flange 524*a* on an end of the sleeve. As such, simplified assembly is permitted and room is provided for the lock structure to first move out of a holding position over load ring 530, but once piston 540 reacts to the pressure differential to drive lock structure 532 against flange 524*a*, the sleeve and the piston act as a unitary member. As noted above, in this embodiment, the lock structure 532 carries the piston face 540 and serves a dual purpose of both retaining the load ring in its locking position and accepting hydraulic force to move the sleeve, the sleeve only being moveable, however, after the lock structure is moved away from a position holding the ring in its gland. As noted above, this action also frees the tool for axial telescopic compression.

Seals 542 may be provided to limit leakage from inner bore 514 past the lock structure 532 and sleeve 524, when it is in the port closing position. It will be appreciated that annularly extending seals may be particularly useful. Seals 542 may take various forms and be formed of various materials, such as, for example, various combinations of elastomerics, metals, rings, o-rings, chevrons, wiper seals, etc.

Generally, the hydraulic pressure is sufficient to move the sleeve. If desired, however, a driver 546 may be provided to assist movement of the sleeve into the port open position and/or act against reverse movement of the sleeve. The driver may be selected to be unable to move the sleeve past load ring 530 when it is held in its gland by lock structure 532. Since driver 546 is unable to overcome the holding power of the load ring, the driver can only move the sleeve once lock structure 532 is removed and load ring 530 able to unseat from gland 534. Driver 546 may take various forms. For example, in one embodiment, driver 546 may include a spring and/or a gas pressure chamber to apply a push or pull force to the sleeve. In the illustrated embodiment, driver 546 employs a spring biased to drive the sleeve along the tubular body away from the port closing position when the sleeve is freed to move.

The sleeve is held against axial movement by its shouldering against part 520 in one axial direction and against load ring 530 in the other axial direction. However, one or more releasable setting devices may be provided to further provide releasable holding of the sleeve in the port closing position. In the illustrated embodiment, releasable setting devices 544, described hereinbefore, serve both to hold lock structure 532 and sleeve 524 in place against inadvertent movement out of their run in positions, but are releasable to permit movement of these parts when it is desirable to do so. In the illustrated embodiment, releasable setting devices 544 may be installed to maintain the sleeve in its port closing position but can be released, as in the present embodiment by shearing, by differential pressure across face 540 to allow movement of the sleeve. While in this embodiment, devices 544 include shear screws engaging the sleeve to lock structure 532, releasable setting devices could be alternately positioned, such as between part 520 and the sleeve. In the present embodiment, the rating and number of shear pins may be selected with reference to various forces such as the tubing pressure that is desired to be applied to move the sleeve and the force applied by driver 546.

Sleeve 524 may be installed in various ways on or in the tubular segment and may take various forms, while being axially moveable along a length of the tubular segment. For example, as illustrated, sleeve 524 may be installed on the outer surface but, again, its position may be selected, as desired.

If desired, a lock may be provided between the first part and the second part to hold the first and second parts 518, 520 in their port closed, overlapping position (FIG. 4C), so that the port cannot be easily or inadvertently reopened. In one embodiment, for example, a ratchet may be provided between the parts. For example, a ratchet latch collet 550 may be installed on first part 518 and a ratchet latch collet 551 may be installed on the second part. The latch collets may be formed and positioned to become engaged when the first part is driven axially into its most overlapping position within the second part. As with ratchet forms, the latch collets may be formed to engage and prevent reverse axial movement due to the form of the engaging teeth thereon. For example, with reference to FIG. 4C, the teeth of latch collets 550, 551 are angled to allow the parts slide together, the teeth on the collets riding up and over each other, but are angled to resist reverse movement, such that the teeth engage when the parts are slid together. The resultant lock resists forces in tension tending to pull the parts apart.

In the illustrated embodiment, ratchet latch collet 551 is axially moveable in a gland that includes a rear gap area and a rear support area. Collet 551, when being axially forced into an engaging position with collet 550, is pushed such that it teeth radially align with the rear gap area such that space is provided for the collet teeth to ride into engagement. However, after the collets are locked up, when a pulling force is applied in an attempt to pull part 518 axially out of part 520, collet 551 is pulled down into the rear support area of its gland and no space is available for teeth of collet 551 to lift out of engagement with the teeth of collet 550.

In one embodiment, ratchet latch collets 550, 551, may be formed to permit a reverse axial movement to reduce the overlapping length of the parts, if it is desired to do so, for example for re-opening ports 522 (FIG. 4D). For example, the teeth on ratchet latch collets can be formed to extend in a spiral, such as in the form of a thread, such that the collets can be disengaged by rotating one part, such as first part 518, relative to the other. Generally, rotation R will be to the right, when viewed from the top. It will be appreciated, therefore, that in such an embodiment, the anti-rotation sections of the tool, if any, are formed to allow such rotation.

If desired, a backup closing sleeve 566 may be carried by the tool to act as a backup seal against fluid leakage after the tool is collapsed. For example, sleeve 566 may be positioned and sized to overlie and close port 522 which a leak could occur back into bore 514. Sleeve 566 may be moved along bore 514 by engagement with a pulling tool 568. An annular recess 570 may be provided to permit sleeve 566 to be recessed out of the main ID of bore 514 and to provide stop walls 572, 573 against which the sleeve may be stored and stopped. A lock 576 may be provided to engage and lock the sleeve in the sealing position over ports 522 when it is moved. A c-ring may be useful for lock 576, for example which is carried with sleeve and lands in an annular recess when sleeve is in a overlying position relative to the ports.

Having thus described the components of the example stage tool 510, the operation of that stage tool will be described. The stage tool may be run into and set in the hole in a condition as shown in FIG. 4A and may be manipulated by hydraulics to a condition shown in FIG. 4B for stage cementing. After the introduction of cement, the tool may be manipulated to a condition shown in FIG. 4C to close off communication through ports 522 between the annulus and the inner bore of the tool.

In summary, the stage tool, installed in a tubing string, will be run into the wellbore with port 522 closed by a removable closure and with the overlap of parts 518, 520 selected that the port is openable by movement of the sleeve alone. Once in position, the tubing string is set in the hole, as by setting of packers, slips etc.

Thereafter, port 522 is opened, as by hydraulic actuation of the sleeve. This allows fluid communication from inner bore 514, through ports 522 to an annulus to be cemented between the tool and the wellbore wall. Cement is then introduced to inner bore 514 which flows out through ports 522 into the annulus. When sufficient cement is introduced, the parts 518, 520 are slid along the interval I, to adjust their overlap to block fluid flow through port 522. This, then, holds the cement in the annulus and time is allowed for the cement to set.

For example, for use, the tool is installed in a tubular string with its inner bore 514 in communication with the inner diameter of the tubing string. In preparation for use, parts 518 and 520 are secured together such that they cannot be pulled further apart, for example by shouldering of shoulders 526*a*, 526*b* of the parts against each other. In this position, sections 536*a*, 536*b* are also engaged to resist rotational movement between the parts.

The parts overlap along interval I and are locked in position by a releasable locking mechanism. In the illustrated embodiment, releasable locking is provided by load ring 530 which is held by structure 532 in gland 534 in the first part. Structure 532 prevents the load ring from moving out of the gland such that the parts cannot be compressed (i.e. driven into greater overlapping condition). The parts overlap in such a way that, if unlocked, movement into further overlapping relation can be achievable. In other words, there is space to accommodate advancement of the parts into a greater overlapping length, but the parts are locked against such movement. Also, in this initial, run in position the overlapping between the parts is selected such that port 522 is not blocked. In addition, a removable closure in the form of sleeve 524 covers port 522 such that, although port is open relative to the overlapping of parts 518, 520, fluid leakage through the port out of bore 514 is substantially prevented by the sleeve. In this illustrated embodiment, sleeve 524 is positioned as the removable closure and releasably set in a port closing position by load ring 530, held in place by lock structure 532.

The string, including tool 510, is then run into the wellbore. Generally, the string will be run in until the stage tool is positioned in an uncased portion of the well wherein an annulus 50 is formed between outer surface 512 and an open hole wall 52. The tubing string may remain supported at surface, either directly or indirectly, such that weight on the string can be adjusted. If necessary, the string inner diameter including bore 514 and the annulus about the tool below port 522 may be sealed as by filling with high density liquid and/or by installation of plugs or packers to deter cement from passing beyond a selected distance below port 522. In one embodiment, for example, a packer may be set in the annulus about the tool below port 522 and a high density liquid may be introduced to the tubing string to reside below port 522.

Once the tubing string is positioned, port 522 may be opened. The port may be opened, for example, at least when it is desired to initiate a cementing operation through the stage tool. However, in some cases, port 522 may be opened earlier, for example, where fluid is required for circulation or for introduction of fluids to the annulus. To open port 522, the removable closure is removed from the port. Once opened, fluid communication is achieved through port 522 from inner bore 514 to outer surface 512 and, in particular with reference to FIG. 1B, annulus 250. In the drawings, the removable closure is embodied by sleeve 524. Sleeve 524 is removed from its covering position over port 522 by fluid pressure applied against piston face 540. The fluid pressure may be increased from surface and communicated to bore 514, for example, through the tubing string extending thereabove. Once fluid pressure is increased to a sufficient level to overcome the holding strength of devices 544, the sleeve can move away from its covering position over port 522. To facilitate and enhance movement, sleeve 524 can be driven by spring 546.

In the illustrated embodiment, the hydraulic drive against piston face 540 releases load ring 530 so that the sleeve can move. Release of load ring 530 also permits the tool to be axially compressed, by driving parts 518, 520 into greater overlapping position. However, until an appropriate time, the string can be held in tension such that the tool is maintained against such compression to maintain ports 522 open.

Where the illustrated tool is employed in a string having other fluid pressure actuated components, the driving pressure of the sleeve should be selected with consideration as to the other components to be actuated and if they need be actuated before or after the sleeve. For example, the sleeve may be selected to only move at pressures greater than the pressures required to move components that must be moved earlier in the tubing string handling, such as, for example, may include packers, slips, etc.

Port 522, being opened to fluid passage therethrough, permits cementing of the annulus. The cement, arrows C, may be pumped from surface to bore 514 and out through ports 522, for example, through the tubing string 504*b* extending thereabove. Introduction of cement continues, as desired, until a suitable volume has been introduced.

During this operation, it is noted that parts 518 and 520 are held such that any overlap therebetween does not block port 522. This may include support of the string above the tool. In a horizontal configuration as shown, however, the weight of the tool and string alone may prevent parts 518, 520 from moving together. In any event, it is desirable that parts 518 and 520 remain in an extended position, for example with shoulders 526*a*, 526*b* set adjacent each other, to keep ports 522 open. However, it will be noted that the movement of the sleeve coincides with movement of structure 534 away from a position overlying the load ring such that the parts are free to compress if compressive force is placed upon them.

When sufficient cement has been introduced, port 522 is closed to hold the cement in the annulus, thereby preventing U-tubing. To close port 522, the stage tool can be compressed (arrows W1) to bring the overlapping length of parts 518, 520 to a position covering port 522 (FIG. 4C). To do so, the tubing string can be lowered from surface to drive parts 518, 520 to slide telescopically together into greater overlapping relation. The sliding movement continues at least until the overlapping region covers port 522 and seals 538 pass over and straddle the port to seal port 522 from annulus 250. In this illustrated embodiment, port 522 is formed in first part 518 and the second part is moved to slide over and overlap with first part at least to a position covering the port. When the first part and the second part are in this overlapping position closing the port, seal 539 may also be employed. Load ring 530 and, if necessary, sleeve 524 are pushed along. These parts 530, 524, not being anymore fixedly secured against axial motion, simply advance as pushed along.

To facilitate the compression of the parts 518, 520, it may be useful to ensure that the string 504*a* below part 520 is held against slipping. As such, prior to compression, it may be useful to brace the string below the tool against axial movement in the well. If desired, therefore, slips and/or packers can be set along the string. This may be accomplished by pressuring up the string. This may be done when the string is first set in the hole. Alternately or in addition, the string can be set against bottom hole.

When the first part and the second part are in this overlapping position closing the port, the string may still be supported to some degree at surface or by installation in the hole. Alternately, the first part 518 may be set down entirely on the lower part, some weight of which may be taken up by the hole in horizontal installations as shown. A stop may be provided to positively limit the overlapping advancement of the parts. For example, the overlapping of the parts may be limited by a shoulder, such as shoulder 567 in second part 520, which stops one part's axial movement along the other part.

If desired, the tool can be locked in this compressed condition. For example, lock structures such as ratchet latch collets 550, 551 may be provided to impart resistance to re-separation of the first and the second parts. For example, with reference to FIG. 4C, the teeth of latch collets 550, 551 are angled to allow the parts slide together, the teeth on the collets riding up and over each other, but are angled to resist reverse movement, such that the teeth engage when the parts are slid together. The resultant lock resists forces in tension tending to pull the parts apart.

If desired, the lock structure can be formed to permit reopening of the ports 522. For example, in the embodiment as shown, the teeth of the latch collets 550, 551 are formed with a spiral thread form such that right hand rotation R (FIG. 4D) can be applied to back the first part out of the second part until the port 522 emerges from the overlap of second part 520. Rotation may require less than 15, less than 10 or possibly even less than 5 complete turns and may be applied with a pulling force (arrows P) to pull the first part and the second part to axially separate, until stopped by shoulders 526*a*, 526*b*. To reclose the ports thereafter, weight (arrows W2) need only be applied again to compress the parts into their overlapping, port closed position (FIG. 4E). Latch collets 550, 551 will again engage to resist reverse axial movement, except as achieved by back threading.

If desired, a backup closure may be a set over the ports 522. While the backup closure may generally be set after the parts are compressed to close ports 522, a backup closure may be employed in any event as a contingency even if ports 522 are not successfully closed. For example, backup closing sleeve 566 may be carried by the tool to act as a back up seal against fluid leakage after the tool is collapsed. For example, sleeve 566 may be positioned and sized to close port 522, to prevent a leak therethrough. Sleeve 566 may be moved along bore 514 by engagement with a pulling tool 568. An annular recess may be provided to permit sleeve 566 to be recessed out of the main ID of bore 514 and to provide stop walls 572, 573 against which the sleeve may be stored and stopped. Sleeve 566 may also be operated in a contingency to close the ports 522 if the parts cannot be successfully compressed.

In the method, to facilitate reentry and/or fluid communication past tool 510, a chasing plug of liquid may be pumped just before the tool is collapsed. As such, it is likely that any fluid remaining in the string may be devoid of settable cement and no drill out is required to open the inner bore. The chasing plug may, for example, include retarder, water, etc.

After the cement is installed and set, wellbore operations may proceed. In some embodiments, wellbore operations may include wellbore fluid treatments such as stimulation including fracturing. In such an embodiment, string manipulations may be necessary below the stage tool. For example, fluid treatment ports may be opened below the stage tool through which treatment fluids will be communicated, sometimes under pressure to the formation. In one embodiment, for example a fracing operation may be carried out on a formation accessed through the wellbore below the stage tool. During fracturing fluids under pressure may be introduced through the tubing string, passing through inner bore 514 of tool 510, and injecting the fluids under pressure out from the tubing string through ports downhole of the stage tool.

In some instances, string manipulation may include pressuring up the string inner bore including bore 514 of the stage tool. As such, the pressures required to achieve movement of sleeve 524 should be considered relative to the pressures required thereafter to manipulate the string components. In some instances, tools, free or connected to strings, must be passed through the string inner bore including bore 514 of the stage tool. Because the stage tool presents full bore ID, substantially without inner diameter constrictions and without the need of internal plugs, such operations are facilitated.

EXAMPLES

In one embodiment, an example technical operations procedure is suggested. This is provided to assist with understanding, but not to be considered restrictive of the invention. The suggested example is as follows:

Pre-Job Planning

During the planning stages, the hydrostatic forces should be calculated to determine the shear value for the fluid treatment ports. The difference between the cement density and the density of the displacement fluid should be considered at the proposed depths of the stage tool.

Wellbore hydraulics should be considered to ensure that the differential pressure will not cause a "light pipe" condition due to string buoyancy.

Shear pin timing should be considered in the program design. The stage tool should be set to shear higher than the any string packers to be set by hydraulics, and lower than the any opening mechanism for wellbore fluid treatment ports, with a reasonable safety factor.

Placement

The Stage Tool should be run in the tool string to a depth to give a minimum of 1 (6.5 bbl) and possibly 2m3 (13 bbl) of annular volume to the planned bottom of the cemented zone, when possible, to allow for adequate flushing.

The tool should be run directly above an open hole packer possibly also including slips for both zonal isolation in the annulus below the cementing ports and for positional locking in the wellbore.

Run in Hole

Run in hole (RIH) speeds may be limited by the packers.

The stage tool is locked in a rigid position until activated hydraulically. Maximum pull through the tool should be considered and kept within acceptable limits.

Once the liner is at depth, full circulation of the well (through a float shoe at the toe of the string) can be established.

Once the fluid is balanced, up/down string weights should be determined.

At this point the packers can be set, for example if hydraulically set by pressuring up the string, and pressure tested following the procedure for these tools.

Once the packers have been set and tested, the tool string may be pulled into tension (for example to about 2,000-5,000 daN) in preparation for cementing.

Tool Function: Cementing

Once the string has been set in tension, the pressure should be brought up to opening pressure (normally about 15 to 25 MPa) in about 5 MPa stages to open the sleeve covering the stage tool ports. Increasing pressure in stages will increase the setting force on the hydraulic packers.

Once the ports are open, circulation back to surface should be established with the existing well fluid.

Once circulation is achieved, the cement program can begin with any required pre-flush, and move into the cement at the planned volumes.

After pumping the required volume of cement, the pumping should be switched over to a 0.5 to 1.5 m3 high viscosity wiper pill and then on to the displacement fluid, preferably without pausing between stages. No plugs are dropped during these steps.

The displacement volume of the casing, plus any additional flush volumes of fluid, should be pumped to displace the cement to the correct level in the annulus and to flush the liner.

Tool Function: Closing the Ports

Once the displacement volume has been delivered, the pressure on the lines should be closed in at the pumping unit.

To close the ports, lower weight down to set the string into compression (about 5,000 daN).

As the stage tool is put into compression, the ports will close as they are overlapped by the second part of the tool and a lock will engage to resist any back axial pull.

After setting weight into the string, the valves at the pumping unit should be slowly opened to monitor for any fluid returns; if no fluid returns are present, then the ports are closed.

To ensure the ports are closed in the locked position, an over-pull of 5,000 daN should be placed on the string; again, monitor for fluid returns during this step.

If no fluid returns from the liner to the pumping unit in either step, the stage tool ports are closed.

Rig out cementing equipment and WOC.

The pipe can be placed in tension (for example, up to 30,000 daN) to set casing slips.

Remedial Step—Ports Will Not Open

If the ports do not open within 15% over the opening pressure, the pressure should be bled off, and additional tension placed into the string (to a maximum of 10,000 daN) before pressuring up again.

Remedial Step—Ports Closed Prematurely or Cannot Circulate

If the string is put into compression prematurely, the indexing mechanism may close the ports preventing any flow into the annulus. This would be visible from surface if circulation was not possible after bringing the tool up to the opening pressure, or if a sudden pressure spike occurred during the pumping operation.

If the ports are determined to have prematurely closed, they can be reopened by placing right-hand rotation into the sting and rotating (for example about 3 to 7 turns) to release the threaded lock at the latch collets.

Continue to work torque into the string until circulation is restored when it is placed in tension.

Remedial Step—Port Seals Not Holding

If port seals do not hold, all returned volume should be pumped back to the well.

As a first step, the string should be placed into further compression (up to 20,000 daN); check returns.

If fluid still returns to the pumping unit during the flow back test, the well should be immediately shut-in at the cement head to hydraulically lock the cement in the annulus.

The cement head should be left in place until the cement has set.

After the cement is set, before fracturing occurs, the secondary sleeve should be shifted closed with a shifting tool.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A stage tool for cementing a wellbore annulus comprising:

a first tubular and a portless second tubular, wherein a longitudinal bore extends through the first tubular and the second tubular;

a fluid port through the first tubular to provide fluidic access between the longitudinal bore and the annulus; and a backup sleeve axially movable in the stage tool adapted to selectively open and close the fluid port against fluid flow therethrough;

wherein the first tubular is axially slidable with respect to the second tubular to close the fluid port upon application of a compressive force.

2. The stage tool of claim 1 further comprising a key in the first tubular and a slot in the second tubular to guide the axial movement of the first tubular.

3. The stage tool of claim 1 further comprising locks to hold the first tubular with the second tubular in a compressed position, to keep the fluid port closed.

4. The stage tool of claim 1 further comprising slips to hold the second tubular in a place inside the wellbore.

5. The stage tool of claim 3, wherein the lock is a ratchet collet lock.

6. A method of cementing a well bore annulus using a stage tool including a first tubular, a portless second tubular, a fluid port on the first tubular, and a longitudinal bore through the first tubular and the second tubular, the method comprising:

running the stage tool into a well bore towards a selected position in the wellbore;

applying hydraulic pressure in the longitudinal bore to shift a backup sleeve to open the fluid port;

pumping the cement through the fluid port into the well bore annulus; and applying a compressive force on the first tubular to axially slide the first tubular towards the second tubular to close the fluid port.

7. The method of claim 6 further comprising guiding the first tubular in the second tubular by a key in the first tubular and a slot in the second tubular.

8. The method of claim 6 further comprising holding the second tubular at the compressed position inside the well bore during the application of compressive force.

9. The method of claim 6 further comprising locking the first tubular and the second tubular to a position upon the closure of the fluid port.

10. The method of claim 6 further comprising moving the backup sleeve to additionally close the fluid port.

* * * * *